United States Patent [19]

Demny et al.

[11] 3,952,570

[45] Apr. 27, 1976

[54] STRETCH REDUCING MILLS

[75] Inventors: Werner Demny; Hermann Moeltner, both of Dusseldorf, Germany

[73] Assignee: Firma Friedrich Kocks, Dusseldorf, Germany

[22] Filed: June 26, 1974

[21] Appl. No.: 483,371

[30] Foreign Application Priority Data

July 4, 1973 Germany ..... 2333916

[52] U.S. Cl. ..... 72/224; 72/235

[51] Int. Cl.[2] ..... B21B 19/02

[58] Field of Search ..... 72/234, 235, 226, 224, 72/366, 209

[56] References Cited

UNITED STATES PATENTS

| | | | |
|---|---|---|---|
| 2,041,937 | 5/1936 | Korbuly | 72/235 X |
| 3,380,278 | 4/1968 | Dilling | 72/224 |
| 3,517,537 | 6/1970 | Cofer | 72/234 |
| 3,611,775 | 10/1971 | Gabel et al. | 72/209 X |
| 3,754,425 | 8/1973 | Bindernagel et al. | 72/234 |

*Primary Examiner*—Milton S. Mehr
*Attorney, Agent, or Firm*—Buell, Blenko, & Ziesenheim

[57] ABSTRACT

A sizing mill is provided for reducing tubes having a number of roll stands arranged one behind the other and in which the sizing pass of at least the first stand is so out of round that the first sizing pass can effect tube reduction over the whole range of external diameters of tubes to be rolled in any given rolling program.

5 Claims, 2 Drawing Figures

STRETCH REDUCING MILLS

Figure 1:
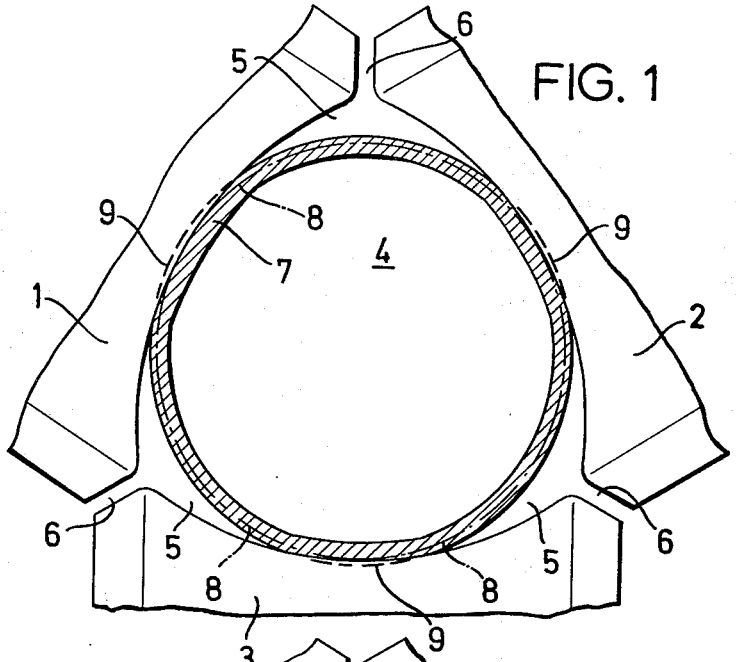

This invention relates to stretch reducing mills and particularly to a reducing mill for tubes having a number of roll stands which are arranged directly one behind the other and whose rolls form out-of-round sizing passes in the first stands in the entry direction.

According to the number of rolls forming a sizing pass, an oval-like configuration or comparable non-circular configuration of the sizing pass is produced in known reducing mills of this type, due to the fact that the grooves of arcuate cross section in the individual rolls deviate from the inscribed circle of the cross section of the sizing pass towards the edges, so that the sizing passes widen towards the gaps between the rolls. If these widenings were not provided, the edges of the roll grooves would produce score lines on the outer surfaces of the tubes. The size of these widenings is firstly dependent upon the reduction of diameter in the particular sizing pass, the greater the reduction in diameter, the larger must be the widenings. Secondly, the ratio of the wall thickness of the tube to its diameter is decisive, the more relatively thin walled is the tube, the larger must be the sizing pass widening. In the known reducing mills, endeavours are made to keep the sizing pass widenings as small as possible in order to keep the radial distribution of stress and deformation in the material of the tube as uniform as possible during the rolling operation, and thus to avoid an out-of-round or polygonal configuration of the cross section of the interior of the tube. Since the diameter reductions in the first sizing passes of the known reducing mills are chosen to be small, in order to avoid the collapsing of the tube, the previously mentioned known design principle leads to initial sizing passes having small widenings, i.e. small out-of-roundness.

However, the small out-of-roundness is disadvantageous when, for example, tubes having a substantially uniform internal diameter but differing wall thicknesses, i.e. tubes having differing external diameters, are to be rolled on a reducing mill with the same set of rolls. This is almost always the case, since the rolling program of such a mill should always include a large number of tubular blooms of various dimensions. Thus, a reducing mill of this type must be able to handle first pass external diameters of varying size. This is necessary, since the first sizing pass is designed for the largest possible external diameter. Consequently, when tubular blooms having smaller external diameters enter the mill, the working surfaces of the rolls of the first sizing pass do not come into contact at all with the external surface of the tubular bloom. The same also applies, according to the size of the external diameter of the incoming bloom, to the second sizing pass and, if required, for several subsequent sizing passes. Thus, for example, only the third or the fourth sizing pass may be the first sizing pass to engage and deform the tubular bloom.

In the first instance, this has the substantial disadvantage that, in dependence upon the external diameter of the incoming tubular bloom, different degrees of stretch occur with a (as is customary) predetermined and (set) range of speed of the driven rolls. There is an increasing loss of elongation as the external diameter of the tubular bloom decreases, since some of the sizing passes no longer participate in the preforming operation and thus tension is present only between a smaller number of sizing passes, which naturally leads to a reduction in the total amount of elongation. Furthermore, the incoming speed of the tubular bloom also varies with the first sizing passes, which can involve difficulties with the apparatus of the plant which is arranged in advance of the reducing mill. Furthermore, the build up of tension which is established, and the progressive variations of the roll speeds from one stand to the next no longer correspond to the predetermined optimum values.

A further disadvantage is the larger number of roll stands required in the known rolling mills in order to roll according to a specific rolling program. Namely, with the known type of roll grooving, the sizing passes had to be so designed at a larger number of sizing pass locations at the entry end that they effect only a small reduction in diameter, since each of these sizing passes could be a first effective sizing pass, and first effective sizing passes must effect only a small reduction in diameter in order to avoid collapsing of the wall of the tube. Thus, a substantial increase in the reduction of the diameter is possible only in the region of the rear stands, for example, after the third or fourth stand.

A feature of the invention is to provide a reducing mill for tubes in which the above-mentioned disadvantages are substantially avoided or mitigated and by means of which a particularly extensive rolling program can be rolled economically.

In accordance with the invention, the sizing pass of the first roll stand is also the first sizing in the case of all external diameters of the incoming tubes which can be rolled in a rolling program using one set of rolls.

Thus, in the first instance, the degrees of elongation when rolling the various tubular blooms can be kept substantially more uniform and no loss of tension occurs as a result of the failure of one or more stands. Furthermore, the entry speed remains substantially constant, so that machines and devices arranged in advance of the reducing mill can be geared to this substantially constant entry speed. The build-up of tension and the reduction in diameter always commence in the first sizing pass and thus can be predetermined and optimally planned when planning the speed ranges of the drive. Consequently, the possibility of larger jumps in the rotational speed can be utilized between the front stands in each case.

In addition to this, the build-up of tension also takes place in the front stands, since no stands are idling as a result of sizing passes working without load.

By virtue of the construction in accordance with the invention, only the first sizing pass has to be so designed that it effects a greatly reduced reduction in diameter. The reduction in diameter increases rapidly in the following sizing passes, so that it is possible to obtain an increased reduction in diameter with the rolling mill constructed in accordance with the invention. Thus, with the reducing mill in accordance with the invention, it is possible to obtain either a larger decrease in the wall thickness and in the diameter with the same number of stands or to obtain a predetermined reduction in the wall thickness and in the diameter with a smaller number of stands. Both these cases involve substantial economic advantages which, on the one hand, reside in a more comprehensive rolling program and, on the other hand, in a smaller rolling mill having smaller spatial requirements and lower prime costs and operating costs.

In a preferred embodiment of the invention, the inscribed circle of the sizing pass in the first roll stand corresponds to the external diameter of the smallest tube, and the circumscribed circle of the sizing pass corresponds substantially to the external diameter of the largest tube of the rolling program. The "inscribed circle" of the sizing pass opening is the circle which just touches the bottom of the groove of each roll of the sizing pass. The circumscribed circle of the sizing pass is the circle which passes through the outermost points of the groove in the region of the gap between adjacent rolls. The center point of the two circles is located in the region of the longitudinal central axis of the material of the workpiece.

This construction provides a first roll pass having a substantially greater out-of-roundness than the corresponding sizing pass of the known reducing mills. The out-of-roundness is no longer chosen in accordance with the reduction in diameter, and to be as small as possible, as in the known construction, but in dependence upon the largest and the smallest external diameter of the first pass. A sizing pass of this kind effects a reduction in diameter which is dependent upon the external diameter of the incoming bloom, and in contrast to the known reducing mills, varies to a great extent. With a uniform internal diameter of the blooms, the thin-walled blooms are only slightly reduced in this sizing pass, while the thick-walled blooms are rolled with the largest reduction. This behaviour complies with the stability conditions of the wall of the bloom, so that, with optimum reduction in diameter, the risk of the wall of the tube collapsing is minimised.

It is usually advisable to make the inscribed circle of the sizing pass slightly smaller than the external diameter of the smallest tube, and to make the circumscribed circle of the sizing pass slightly larger than the external diameter of the largest tube. This ensures that, when rolling the smallest tube of the program, the bloom is reliably engaged and deformed by the first roll pass upon entry, and that a tension can build up between the first and second stand. Furthermore, it is ensured that, when rolling the largest tube of the program, this tube can be drawn into the reducing mill by the first roll pass without difficulties with respect to grip. Furthermore, the roll groove edges are reliably prevented from pressing into the surface of the tube.

Furthermore, it is advisable to reduce the greater out-of-roundness of the sizing passes, resulting in accordance with the invention, to the conventional size in a stepwise manner in the second and in the following roll stands. Thus, disadvantages with respect to the polygonal configuration of the cross section of the interior of the tube may be avoided. Furthermore, difficulties are avoided which can otherwise occur during abrupt transition from a sizing pass of large out-of-roundness to a conventional sizing pass of small out-of-roundness.

Figure 2:
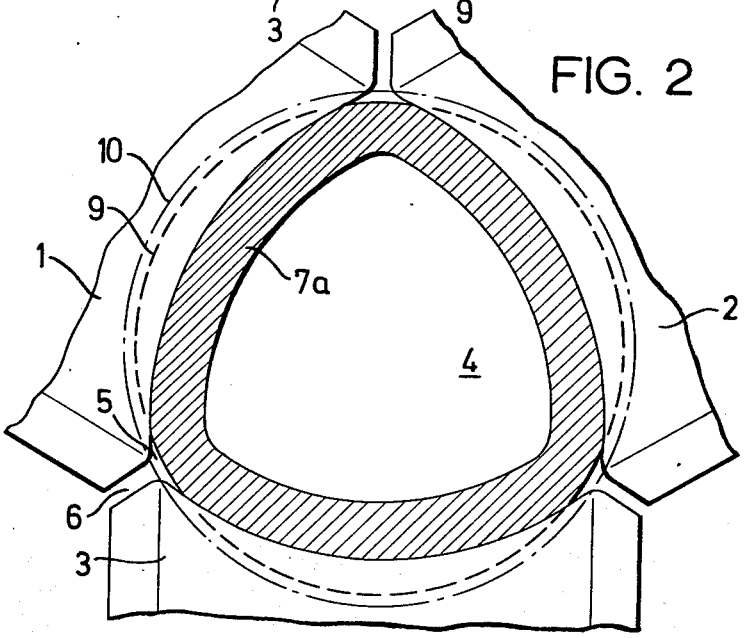

The invention is further described, by way of example, with reference to the accompanying drawings, in which:

FIG. 1 shows a roll pass of a first stand of a reducing mill, in accordance with the invention, having an incoming, thin-walled tubular bloom; and FIG. 2 shows the sizing pass of FIG. 1, having an incoming, thick-walled tubular bloom.

Referring to FIG. 1, three rolls 1, 2 and 3 of the first stand of a tube reducing mill have peripheral grooves which form a sizing pass 4. The rolls are disc-like and are arranged at 120° to one another, only a minute portion of the grooved periphery of each roll being shown. The sizing pass 4 is not circular, but has widenings 5 located in the region of the gaps 6 between the individual rolls. A tubular bloom 7, having a relatively small wall thickness, enters the sizing pass 4. The tubular bloom 7 is reduced in diameter in the region of the groove bottom of each roll 1 to 3, since the inscribed circle 8 of the sizing pass 4 is slightly smaller than the original external diameter 9 of the tubular bloom 7.

Referring to FIG. 2, a thick-walled tubular bloom 7*a* enters the same sizing pass as is shown in FIG. 1, the original external diameter of the bloom 7*a* being almost the same size as the circumscribed circle 10 of the sizing pass 4. As may be clearly seen, the rolls 1 to 3 of the sizing pass effect a relatively large reduction in the diameter of the tubular bloom 7*a*, a reduction which is substantially greater than the reduction in the diameter of the tubular bloom 7 of FIG. 1. The larger reduction in diameter is rendered possible by virtue of the particularly large wall thickness of the tubular bloom 7*a*, without any risk of the collapse of the wall of the tube. Due to the sizing pass widenings 5, the tubular 7*a* of FIG. 2 is provided with a pronounced three-sided out-of-round configuration which, however, is eliminated by making the sizing passes of the following stands (not illustrated) of the reducing mill progressively less and less out-of-round towards the delivery end of the reducing mill.

In the foregoing specification we have set out certain preferred embodiments and practices of our invention, however, it will be understood that this invention may be otherwise embodied within the scope of the following claims.

We claim:

1. A stretch reducing mill for tubes being rolled without mandrels, said mill having a number of successive motor driven roll stands which are arranged directly one behind the other with successively smaller sizing passes to a final finishing pass, each stand having three grooved rolls defining a said sizing pass and arranged at 120° to one another, in which at least the first sizing pass is defined by groove means of a non-circular curved configuration to effect the reduction of incoming tubes having a range of external diameters.

2. A stretch reducing mill as claimed in claim 1, in which the smallest dimension of said first sizing pass is slightly smaller than the external diameter of the smallest incoming tube and the largest dimension of said first sizing pass is slightly larger than the external diameter of the largest incoming tube.

3. A stretch reducing mill as claimed in claim 1, in which the sizing pass of the stand immediately succeeding the first stand decreases in out-of-roundness from the sizing pass of the first stand.

4. A method of reducing tubes being rolled without mandrels comprising the steps of passing a tube to be reduced through a succesion of motor driven roll stands which are arranged directly one behind the other with successively smaller sizing passes to a final finishing pass, each of said stands having three grooved rolls arranged at 120° to one another with the grooves of at least the first sizing pass being defined by groove means of a non-circular curved configuration, said first sizing pass thereby effecting reduction of incoming tubes having a range of external diameters.

5. A method as claimed in claim 4 in which the smallest dimension of said first sizing pass is slightly smaller than the external diameter of the smallest incoming tube and the largest dimension of said first sizing pass is slightly larger than the external diameter of the largest incoming tube.

* * * * *